US009366210B2

(12) United States Patent
Fischer et al.

(10) Patent No.: US 9,366,210 B2
(45) Date of Patent: Jun. 14, 2016

(54) FUEL INJECTION SYSTEM HAVING A FUEL-CARRYING COMPONENT, A FUEL INJECTOR AND A CONNECTING DEVICE

(71) Applicants: Michael Fischer, Niefern-Oeschelbronn (DE); Michael Knorpp, Weissach (DE); Martin Riemer, Untergruppenbach (DE); Hans-Georg Horst, Leonberg (DE); Andreas Glaser, Stuttgart (DE); Philipp Rogler, Stuttgart (DE); Jan Herrmann, Stuttgart (DE); Andreas Rehwald, Bietigheim-Bissingen (DE); Michael Mayer, Wannweil (DE); Volker Scheef, Ludwigsburg (DE); Wilhelm Reinhardt, Oetisheim (DE)

(72) Inventors: Michael Fischer, Niefern-Oeschelbronn (DE); Michael Knorpp, Weissach (DE); Martin Riemer, Untergruppenbach (DE); Hans-Georg Horst, Leonberg (DE); Andreas Glaser, Stuttgart (DE); Philipp Rogler, Stuttgart (DE); Jan Herrmann, Stuttgart (DE); Andreas Rehwald, Bietigheim-Bissingen (DE); Michael Mayer, Wannweil (DE); Volker Scheef, Ludwigsburg (DE); Wilhelm Reinhardt, Oetisheim (DE)

(73) Assignee: Robert Bosch GmbH, Stuttgart (DE)

( * ) Notice: Subject to any disclaimer, the term of this patent is extended or adjusted under 35 U.S.C. 154(b) by 151 days.

(21) Appl. No.: 14/158,712

(22) Filed: Jan. 17, 2014

(65) Prior Publication Data

US 2014/0202432 A1 Jul. 24, 2014

(30) Foreign Application Priority Data

Jan. 18, 2013 (DE) ..... 10 2013 200 781

(51) Int. Cl.

| | |
|---|---|
| ***F02M 1/00*** | (2006.01) |
| ***F02M 61/14*** | (2006.01) |
| ***F02M 55/00*** | (2006.01) |
| *F02M 51/06* | (2006.01) |

(52) U.S. Cl.

CPC ..... *F02M 61/14* (2013.01); *F02M 55/004* (2013.01); *F02M 55/005* (2013.01); *F02M 51/0671* (2013.01); *F02M 2200/09* (2013.01); *F02M 2200/853* (2013.01); *F02M 2200/856* (2013.01)

(58) Field of Classification Search

CPC ..... F02M 61/14
USPC ..... 123/468–471
See application file for complete search history.

(56) References Cited

U.S. PATENT DOCUMENTS

| | | | | |
|---|---|---|---|---|
| 4,294,215 | A | 10/1981 | Hans et al. | |
| 2010/0154746 | A1 * | 6/2010 | Fischer | F02M 61/14 123/456 |
| 2010/0218742 | A1 * | 9/2010 | Fischer | F02M 55/02 123/456 |
| 2011/0155824 | A1 * | 6/2011 | Fischer | F02M 61/14 239/533.2 |
| 2012/0031375 | A1 * | 2/2012 | Fischer | F02M 61/14 123/445 |
| 2014/0203110 | A1 * | 7/2014 | Fischer | F02M 37/0017 239/584 |

FOREIGN PATENT DOCUMENTS

| | | |
|---|---|---|
| DE | 2908095 | 9/1980 |

* cited by examiner

*Primary Examiner* — John Kwon
(74) *Attorney, Agent, or Firm* — Norton Rose Fulbright US LLP

(57) ABSTRACT

A connecting device for fuel injection systems is used for connecting a fuel injection valve to a fuel-carrying component. A wire-shaped connecting element is provided in this context, which is fastened, on the one hand, to the fuelcarrying component and, on the other hand, to the fuel injection valve. The wire-shaped connecting element is embodied closed in an annular manner, and, on the one hand, is guided about a shoulder of the fuel-carrying component and, on the other hand, about a shoulder of the fuel injection valve. A fuel injection system having such a connecting device is also provided.

12 Claims, 3 Drawing Sheets -

FUEL INJECTION SYSTEM HAVING A FUEL-CARRYING COMPONENT, A FUEL INJECTOR AND A CONNECTING DEVICE

FIELD OF THE INVENTION

The present invention relates to a connecting device for fuel injection systems for the connection of a fuel injector to a fuel-carrying component and a fuel injection system having such a connecting device. The present invention particularly relates to the field of fuel injection systems for mixture-compressing internal combustion engines having externally supplied ignition.

BACKGROUND INFORMATION

A fuel injection system is known, from German Published Patent Appln. No. 29 08 095, for internal combustion engines having a plurality of fuel injectors, of which each, at its one end, is connected via a connection piece in a sealing manner to a barb nipple of an in-common, dimensionally stable, fuel distributor line, and has an orifice at another end. In this instance, each fuel injector is connected to the fuel distributor line by respectively one flexible, appropriately formed retaining clip which encompasses the fuel distributor and the fuel distributor line or the barb nipple. The retaining clip may be made of spring steel wire, in this case. The retaining clip may further be developed loop-shaped and be latched in on the barb nipple or the fuel distributor line with its loop portion facing away from the mounting points on the fuel injector The fuel injection system known from German Published Patent Appln. No. 29 08 095 has the disadvantage that, because of the retaining clip, only an assurance against the release of the plug connection between the fuel distributor line and the fuel injectors and possibly more rapid assembly are achieved, for this, however, an additional component, namely the retaining clip being required and having to be mounted in addition. On account of the additionally required rigid insertion of the fuel injectors into inner bores of the barb nipples, what takes place in addition is the transmission of vibrations between the fuel injectors and the fuel distributor line. Consequently, the embodiment of the known fuel injection system is not suitable for applications in which such a vibration transmission is undesirable, based on noise development in connection with it, for example.

Especially in the case of electromagnetic high-pressure fuel injectors, which may be used in Otto engines having direct injection, a loud and disturbing contribution to the overall noise of the engine may occur, which has been described as valve ticking. Such valve ticking is created by the rapid opening and closing of the fuel injector, in which the valve needle is displaced with high dynamics to the respective end stops. The impact of the valve needle on the end stops leads to brief but very high contact forces which are transferred via a housing of the fuel injector to the cylinder head and to a fuel manifold in the form of structure-borne noise and vibrations. This leads to a strong noise development at the cylinder head and at the fuel manifold.

SUMMARY

The connecting device according to the present invention and the fuel injection system according to the present invention have the advantage that an improved connection of the fuel injector to the fuel-carrying component is made possible, whereby a noise reduction is made possible. In particular, a soft connection of the fuel injector to the fuel-carrying component may be achieved.

The connecting device and the fuel injection system are particularly suitable for the direct fuel injection. The fuel-carrying component is preferably developed in this instance as a fuel distributor, especially as a fuel manifold. On the one hand, the fuel distributor may be used for distributing the fuel to a plurality of fuel injectors, especially high-pressure injectors. On the other hand, the fuel distributor may be used as an in-common fuel reservoir for the fuel injectors. The fuel injectors are then preferably connected to the fuel distributor via corresponding connecting devices. In operation, the fuel injectors then inject the fuel required for the combustion process into the respective combustion chamber under high pressure. In the process, the fuel is supplied to the fuel manifold via a high pressure pump.

The fuel-carrying component and the fuel injector are not components of the connecting device according to the present invention. In particular, the connecting device according to the present invention may also be produced and marketed separately from the fuel-carrying component as well as from a fuel injector.

It is advantageous that an elastic suspension for the fuel injector is provided on the fuel-carrying component, which includes the at least one connecting element. In particular, two connecting elements may be provided which enable an advantageous connection of the fuel injector to the fuel-carrying component. Thereby, in particular, four expansion sections may be implemented by which an elasticity of the elastic suspension is ensured. In particular, the modulus of elasticity of the elastic suspension may advantageously not be greater than 50 kN/mm.

It is also advantageous that the elastic suspension has a plate-shaped elastic element and that the wire-shaped connecting element is able to be fastened, for one, to the shoulder of the fuel-carrying component, using the plate-shaped, elastic element. In addition or alternatively, the elastic suspension may have a plate-shaped elastic element, via which the wire-shaped connecting element is able to be fastened, for another, to the shoulder of the fuel injector. Thereby, an elasticity of the elastic suspension is wholly or partially ensured via the at least one plate-shaped elastic element. It is also possible, thereby, to produce the wire-shaped connecting element to be stiffer, if necessary. This works out favorably for a possibly required stability, which is to be ensured at high system pressures over the service life.

In an advantageous manner, such a plate-shaped elastic element may be formed of, or at least partially consist of spring sheet metal, a disk spring, a plastic disk or a metal wire mesh.

It is also advantageous that the wire-shaped connecting element has an average cross sectional area, in its expansion sections which extend along a longitudinal axis, which makes possible over a length of the expansion section an elastic expansion of the wire-shaped connecting element. In this instance, a design may especially be implemented in which, while taking into account the length, an axial rigidity of not more than 50 kN/mm is achieved.

It is also of advantage that the wire-shaped connecting element is embodied having at least one bend in a first expansion section which extends along a longitudinal axis, that the wire-shaped connecting element in a second expansion section, which extends along a longitudinal axis, is embodied having at least one bend, and that the first expansion section and the second expansion section extend separately from each other next to the fuel injector along the longitudinal axis. In this instance, a wave-shaped bending, for example, may be provided in each of the two expansion sections. However, it is also advantageous that the first expansion section and the second expansion section are bent at least partially towards each other and/or at least partially towards the longitudinal axis. This yields a compact embodiment and at the same time a simple way of producing the wire-shaped connecting element.

DETAILED DESCRIPTION

Figure 1:
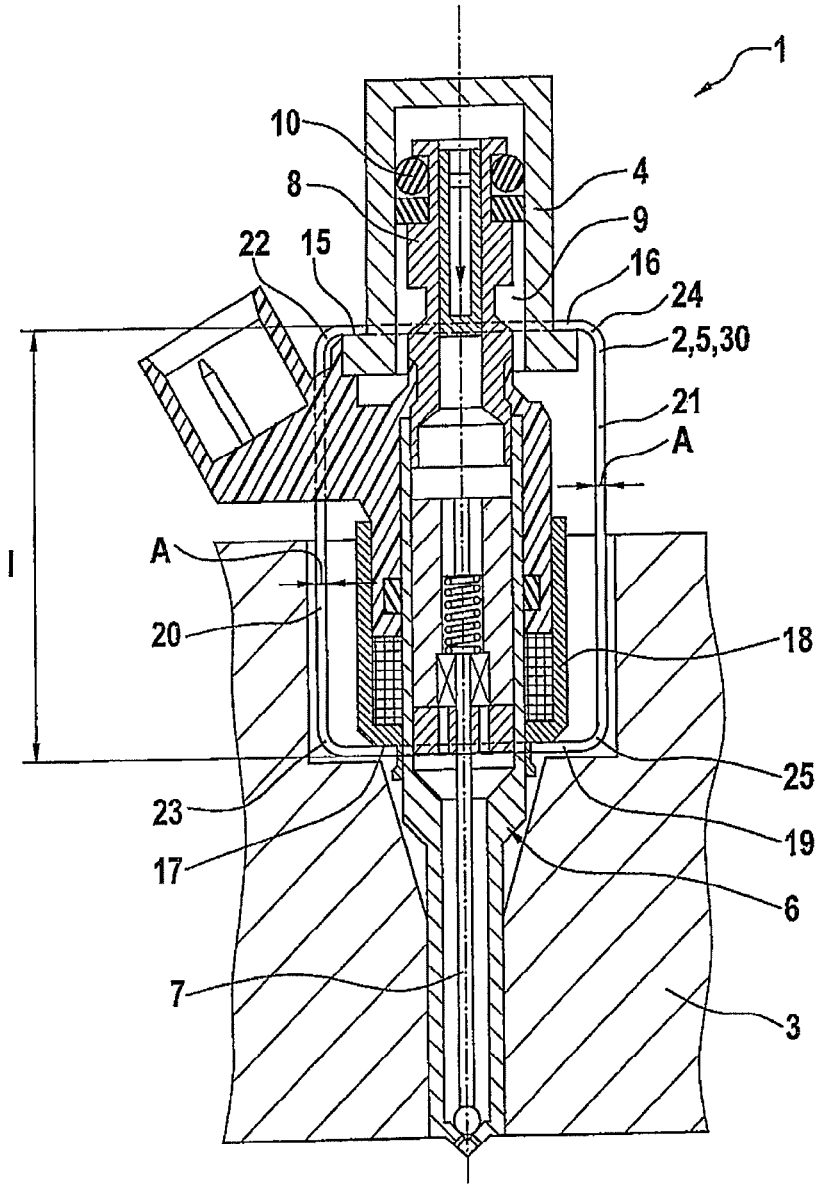
FIG. 1 shows a fuel injection system having a connecting device corresponding to a first exemplary embodiment of the present invention and an internal combustion engine in an excerpted, schematic sectional representation.

FIG. 1 shows a fuel injection system 1 having a connecting device 2 corresponding to a first exemplary embodiment and an internal combustion engine 3 in an excerpted, schematic sectional representation. Fuel injection system 1 may be particularly used for high-pressure injection in internal combustion engines 3. In particular, fuel injection system 1 may be used in mixture compressing internal combustion engines 3 having externally supplied ignition. Connecting device 2 is particularly suitable for such a fuel injection system 1.

Fuel injection system 1 has a fuel-carrying component 4. In this case, in FIG. 1, a cup 4 of fuel-carrying component 4 is shown which, for example, is a component of a fuel manifold.

Connecting device 2 has a wire-shaped connecting element 5, which is embodied to be closed in an annular fashion. In this instance, connecting device 2 has a still further connecting element, for example, which is embodied corresponding to connecting element 5. Connecting element 5 and the further connecting element are preferably situated on both sides of a fuel injection valve 6, connecting element 5 and the further connecting element lying opposite with respect to a longitudinal axis 7 of fuel injection valve 6 and cup 4.

Fuel injection valve 6 has a fuel fitting 8 which is at least partially fitted into an accommodation space 9 of cup 4. A sealing element 10 is provided for sealing between fuel fitting 8 and cup 4.

On cup 4 a shoulder 15 is embodied, about which an upper section 16 of connecting element 5 is guided.

Fuel injection valve 6 has a shoulder 17 which, in this exemplary embodiment, is embodied on a magnetic pot 18 of fuel injection valve 6. A lower section 19 of connecting element 5 is guided around shoulder 17.

Wire-shaped connecting element 5 has additionally a first expansion section 20 and a second expansion section 21. Expansion sections 20, 21 each extend in this case along longitudinal axis 7, from upper section 16 to lower section 19. In this specific embodiment, expansion sections 20, 21 are at least approximately rectilinear and are embodied parallel to longitudinal axis 7. Expansion sections 20, 21 are, on the one hand, connected to each other at shoulder 15 of cup 4, via upper section 16 and, on the other hand, at shoulder 17 of fuel injection valve 6.

Consequently, wire-shaped connecting element 5 is guided, on the one hand, about shoulder 15 of cup 4 and, on the other hand, about shoulder 17 of fuel injection valve 6. In this case, expansion sections 20, 21 are elastically deformable along longitudinal axis 7. Thereby, connecting element 5 is embodied as a fastening spring 5. In this exemplary embodiment, annularly closed connecting element 5 is embodied in the form of a closed rectangle having rounded corners. Between connecting element 5 and internal combustion engine 3, particularly a cylinder head 3, there remains an air gap in this instance, so that at this place there occurs no contact between fuel injection valve 6 and internal combustion engine 3 via connecting element 5. It is on account of this that a soft suspension of fuel injection valve 6 is implemented.

The spring effect in this exemplary embodiment comes about due to the elasticity of expansion sections 20, 21 of connecting element 5 over a length I from upper section 16 to lower section 19 along longitudinal axis 7. This corresponds approximately to an elastic fastening using two expansion rods per connecting element 5. If connecting element 5 and exactly one further connecting element are provided, this fastening corresponds to an elastic fastening using four expansion rods. Expansion sections 20, 21 have the function of expansion rods, in this case. Possible bending at rounded corners 22, 23, 24, 25 will be regarded in the following as negligible, but may be taken into account additionally, depending on the embodiment of connecting element 5. This is possible in particular by one embodiment in which upper section 16 and lower section 19 each extend laterally over respective shoulder 15, 17. It is true that the space requirement becomes greater thereby.

First expansion section 20 and second expansion section 21 have the same cross sectional area A in this exemplary embodiment. In an irregular embodiment, if necessary, one might also observe an average cross sectional area A.

An axial rigidity k of the fastening spring suspension may thus be approximately determined according to the formula $k=EA/1$.

Especially in the case of a circular cross sectional area A, this may be determined from the diameter D according to the formula $A=\pi D^2/4$, where $\pi$ is the Ludophine number.

Consequently, a soft suspension is implementable, the rigidity of the elastic suspension not being able to be greater than 50 kN/mm and the rigidity in this exemplary embodiment being determined by the axial rigidity k of expansion sections 20, 21.

Connecting device 2 may have connecting element 5 and one additional element, for example, so that altogether four expansion sections come about, which include expansion sections 20, 21. In the case of identical embodiments, for example, the rigidity named of not more than 50 kN/mm may be achieved by the selection of length I of 50 mm and a wire diameter D of 2 mm, if a suitable steel having a modulus of elasticity of not more than 220 GPa is selected, which is typical for spring steel.

Thus, in this exemplary embodiment, an elastic suspension 30 is formed which includes connecting element 5 and the further connecting element.

Figure 2:
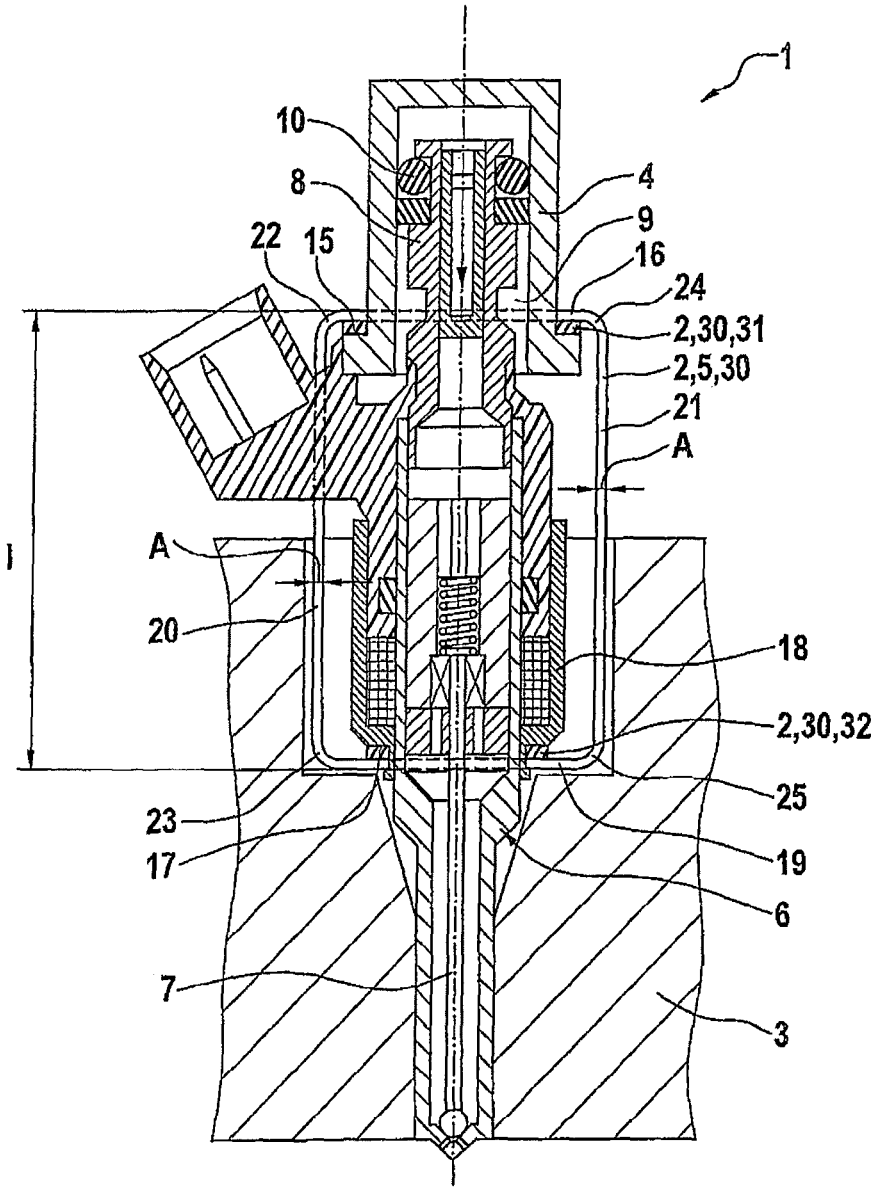
FIG. 2 shows a fuel injection system having a connecting device corresponding to a second exemplary embodiment of the present invention and an internal combustion engine in an excerpted, schematic sectional representation

FIG. 2 shows a fuel injection system 1 having a connecting device 2 corresponding to a second exemplary embodiment and an internal combustion engine 3 in an excerpted, schematic sectional representation. In this exemplary embodiment, elastic suspension 30 of connecting device 2 also includes plate-shaped elastic elements 31, 32.

Plate-shaped elastic element 31 is situated in this case between upper section 16 of connecting element 5 and shoulder 15 of cup 4. Because of this, wire-shaped connecting element 5 is fastened, on the one hand, using plate-shaped elastic element 31, on shoulder 15 of cup 4.

Plate-shaped elastic element 32 is situated between lower section 19 of connecting element 5 and shoulder 17 of fuel injection valve 6. Thereby, wire-shaped connecting element 5 is fastened, using plate-shaped elastic element 32, to shoulder 17 of fuel injection valve 6. The entire elasticity of elastic suspension 30 is determined via an elasticity of plate-shaped elastic element 31 and an elasticity of plate-shaped elastic element 32, in addition to an elastic behavior of expanding sections 20, 21 This makes possible a more elastic embodiment of elastic suspension 30. Furthermore, expansion sections 20, 21 could also be embodied having greater rigidity, that means having a lower axial rigidity k according to Formula (1), in order to achieve a specified overall rigidity, since plate-shaped elastic elements 31, 32 make an additional contribution to the elasticity.

Thus, plate-shaped elastic elements 31, 32 may be used as additional elastic support elements 31, 32. If necessary, only one of the plate-shaped elastic elements 31, 32 may be provided. Plate-shaped elastic elements 31, 32 may in each case be embodied wholly or partially as spring steel, a disk spring, a plastic disk or a metal wire mesh. If necessary, in order to distribute the compressive load per unit area, additional compensating disks may be provided between upper section 16 and lower section 19 and associated plate-shaped elastic element 31, 32. This embodiment has the advantage, among other things, that because of a possibly more rigid embodiment of expansion sections 20, 21, the mechanical tensions in wire-shaped connecting element 5 are able to be reduced.

Figure 3:
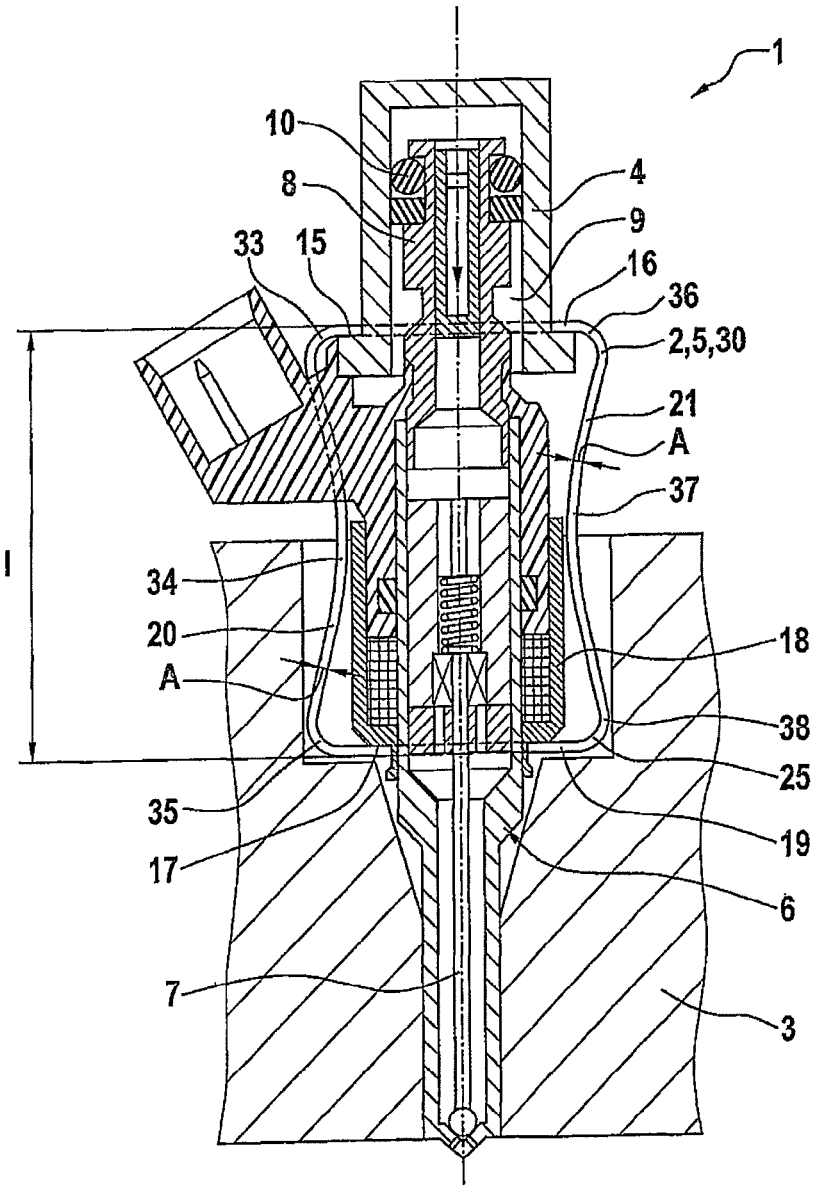
FIG. 3 shows a fuel injection system having a connecting device corresponding to a third exemplary embodiment of the present invention and an internal combustion engine in an excerpted, schematic sectional representation.

FIG. 3 shows a fuel injection system 1 having a connecting device 2 corresponding to a third exemplary embodiment and an internal combustion engine 3 in an excerpted, schematic sectional representation. In this exemplary embodiment, first expansion section 20 and second expansion section 21 extend on both sides slightly over shoulder 15 of cup 4 and shoulder 17 of magnetic pot 18. In addition, first expansion section 20 has bends 33, 34, 35. Furthermore, second expansion section 21 has bends 36, 37, 38. Bend 34 of first expansion section 20 and bend 37 of second expansion section 21 are bent towards each other by this. Bend 34 of first expansion section 20 and bend 37 of second expansion section 21 may also be bent towards longitudinal axis 7. Moreover, an embodiment is also possible in which first expansion section 20 and second expansion section 21, at their bends 34, 37 are partially bent towards each other and partially towards longitudinal axis 7.

The elasticity of connecting element 5 is further improved by bends 33 to 38 of expansion sections 20 to 21. Thereby, expansion sections 20, 21 may also be provided with a plurality of bends 33 to 38, in order to achieve a wavy embodiment of expansion sections 20, 21. The number and the form of bends 33 to 38 may be adapted to the respective case of application, in this instance. Thus, embodiments having higher waviness are also conceivable. Because of bends 33 to 38, the elasticity is additionally implemented by the geometric embodiment of connecting element 5. By different designs of bends 33 to 38, the proportion of wire bending and wire extension may be designed freely within certain limits. This opens additional degrees of freedom in the design of connecting element 5 and enables in principle lower rigidities of the suspension, at simultaneously lower mechanical stress of the wire for wire-shaped connecting element 5.

Accordingly, an additional connecting element, which is embodied corresponding to connecting element 5, may also be provided. Furthermore, in a modified embodiment, plate-shaped elastic elements 31, 32 may also be provided, as is described with reference to FIG. 2.

Consequently, a soft suspension 30 of fuel injection valve 6 with respect to cup 4 may be achieved, having a desired target rigidity, particularly a target rigidity of not more than 50 kN/mm, the rigidity requirements being at the same time maintained over the service life. Because of elastic suspension 30, a clear reduction is possible of transmitted structure-borne noise from fuel injection valve 6 to cup 4 and to the fuel manifold. Connected to that is a reduction of the noise of fuel injection system 1. Besides that, this measure may also be implemented to form additional noise-reducing measures, such as a hydraulic throttle at the valve inlet and a soft rail screw connection.

Besides that, there is yielded a robust and cost-effectively implementable possibility for noise reduction, which is also easy to mount. Thereby the advantage comes about that additional fixing elements or the like may be omitted. A possibly required dismounting may also take place in a simple manner.

Connecting element 5 may advantageously engage directly with cup 4, and may encompass fuel injection valve 6 at bottom (shoulder) 17 of magnetic pot 18. Thereby an implementation is possible, without substantial or with only slight constructive changes on cup 4 and fuel injection valve 6. Because of a preferably overall annularly closed embodiment of wire-shaped connecting element 5, the stresses occurring within wire-shaped connecting element 5 are also accommodated well, bending open or the like being constructively prevented.

The present invention is not limited to the exemplary embodiments described.

What is claimed is:

1. A connecting device for a fuel injection system for connecting a fuel injection valve to a fuel-carrying component, comprising:

at least one wire-shaped connecting element which is able to be fastened to the fuel-carrying component and is able to be fastened to the fuel injection valve, wherein:

the wire-shaped connecting element is at least essentially in the form of a closed loop, the wire-shaped connecting element is able to be guided about a shoulder of the fuel-carrying component, and the wire-shaped connecting element is able to be guided about a shoulder of the fuel injection valve.

2. The connecting device as recited in claim 1, further comprising:

an elastic suspension for the fuel injection valve on the fuel-carrying component that includes the at least one wire-shaped connecting element.

3. The connecting device as recited in claim 2, wherein a rigidity of the elastic suspension is not greater than 50 kN/mm.

4. The connecting device as recited in claim 2, wherein:

the elastic suspension includes at least one plate-shaped elastic element, and the wire-shaped connecting element is able to be fastened to the shoulder of the fuel-carrying component, at least using the plate-shaped elastic element.

5. The connecting device as recited in claim 2, wherein:

the elastic suspension includes at least one plate-shaped elastic element, and the wire-shaped connecting element is able to be fastened to the shoulder of the fuel injection valve, at least using the plate-shaped elastic element.

6. The connecting device as recited in claim 4, wherein the plate-shaped elastic element includes one of a spring sheet metal, a disk spring, a plastic disk, and a metal wire mesh.

7. The connecting device as recited in claim 1, wherein the wire-shaped connecting element includes an average cross sectional area at least in one expansion section that extends along a longitudinal axis specified so that an elastic expansion of the wire-shaped connecting element is made possible over a length of the expansion section.

8. The connecting device as recited in claim 1, wherein:

the wire-shaped connecting element includes at least one bend in a first expansion section that extends along a longitudinal axis, the wire-shaped connecting element includes at least one bend in a second expansion section that extends along the longitudinal axis, and the first expansion section and the second expansion section extend separately from each other next to the fuel injection valve along the longitudinal axis.

9. The connecting device as recited in claim 8, wherein the first expansion section and the second expansion section are bent at least one of at least partially towards each other and at least partially towards the longitudinal axis.

10. The connecting device as recited in claim 1, wherein an air gap is provided between the wire-shaped connecting element and a cylinder head of an internal combustion engine.

11. A fuel injection system, comprising:

at least one fuel-carrying component:

at least one fuel injection valve; and at least one connecting device, wherein the fuel injection valve is connected to the fuel-carrying component via the connecting device, the connecting device including:

at least one wire-shaped connecting element which is able to be fastened to the fuel-carrying component and is able to be fastened to the fuel injection valve, wherein:

the wire-shaped connecting element is at least essentially in the form of a closed loop, the wire-shaped connecting element is able to be guided about a shoulder of the fuel-carrying component, and the wire-shaped connecting element is able to be guided about a shoulder of the fuel injection valve.

12. The fuel injection system as recited in claim 11, wherein the fuel injection system is for a mixture compressing internal combustion engine having an externally supplied ignition.

* * * * *